US009905160B2

(12) United States Patent
Woo et al.

(10) Patent No.: US 9,905,160 B2
(45) Date of Patent: Feb. 27, 2018

(54) ORGANIC LIGHT EMITTING DIODE DISPLAY FOR SENSING ELECTRICAL CHARACTERISTIC OF DRIVING ELEMENT

(71) Applicant: LG DISPLAY CO., LTD., Seoul (KR)

(72) Inventors: Kyoungdon Woo, Paju-si (KR); Myunggi Lim, Ansan-si (KR)

(73) Assignee: LG DISPLAY CO., LTD., Seoul (KR)

( * ) Notice: Subject to any disclaimer, the term of this patent is extended or adjusted under 35 U.S.C. 154(b) by 56 days.

(21) Appl. No.: 14/851,154

(22) Filed: Sep. 11, 2015

(65) Prior Publication Data

US 2016/0078805 A1 Mar. 17, 2016

(30) Foreign Application Priority Data

Sep. 12, 2014 (KR) ..... 10-2014-0121091

(51) Int. Cl.
*G09G 3/3233* (2016.01)
*G09G 3/3225* (2016.01)

(52) U.S. Cl.
CPC ..... *G09G 3/3225* (2013.01); *G09G 3/3233* (2013.01); *G09G 2300/0842* (2013.01); *G09G 2320/0295* (2013.01); *G09G 2320/043* (2013.01); *G09G 2320/045* (2013.01)

(58) Field of Classification Search
CPC ..... G09G 3/3225; G09G 3/3233; G09G 2320/043; G09G 2320/0295; G09G 2300/0842; G09G 2320/045; G09G 2320/029
See application file for complete search history.

(56) References Cited

U.S. PATENT DOCUMENTS

2006/0007206 A1* 1/2006 Reddy ..... G06F 3/03542 345/204
2009/0213049 A1* 8/2009 McCreary ..... G09G 3/3233 345/80
2010/0277400 A1* 11/2010 Jeong ..... G09G 3/3275 345/76
2011/0254871 A1* 10/2011 Yoo ..... G09G 3/3233 345/690

(Continued)

FOREIGN PATENT DOCUMENTS

CN 201639647 U 11/2010
CN 103854602 A 6/2014

OTHER PUBLICATIONS

Chinese Search Report First Office Action dated Aug. 2, 2017.

*Primary Examiner* — Darlene M Ritchie
(74) *Attorney, Agent, or Firm* — Dentons US LLP

(57) ABSTRACT

An organic light emitting diode display is disclosed. The organic light emitting diode display includes a display panel including a plurality of pixels, a plurality of sensing units configured to integrate current information of the pixels through a plurality of sensing channels connected to sensing lines of the display panel and output a first sensing value, a reference sensing unit configured to integrate previously set reference current information and output a reference sensing value, a calculation block configured to calculate the first sensing value and the reference sensing value, remove a common noise component from the first sensing value, and output a second sensing value, and an analog-to-digital converter configured to convert the second sensing value into a digital sensing value.

2 Claims, 8 Drawing Sheets

(56) References Cited

U.S. PATENT DOCUMENTS

| | | | | |
|---|---|---|---|---|
| 2011/0279444 | A1* | 11/2011 | Chung | G09G 3/3233 345/214 |
| 2013/0016091 | A1* | 1/2013 | Kato | G09G 3/3225 345/419 |
| 2013/0300690 | A1 | 11/2013 | Yang et al. | |
| 2014/0009216 | A1 | 1/2014 | Jo et al. | |
| 2014/0152642 | A1* | 6/2014 | Kim | G09G 3/3233 345/212 |
| 2014/0198092 | A1* | 7/2014 | Azizi | G09G 3/006 345/212 |
| 2014/0347332 | A1* | 11/2014 | Lee | G09G 3/3233 345/204 |
| 2015/0009204 | A1* | 1/2015 | Chaji | G09G 3/3233 345/214 |
| 2015/0048881 | A1* | 2/2015 | Kwon | H03H 19/004 327/554 |
| 2015/0077314 | A1* | 3/2015 | Kim | G09G 3/3233 345/76 |
| 2015/0138177 | A1* | 5/2015 | Kwon | G09G 3/3233 345/211 |
| 2016/0300534 | A1* | 10/2016 | Kishi | G09G 3/3233 |
| 2017/0104480 | A1* | 4/2017 | Eshel | H03K 5/1252 |

* cited by examiner

| Step | a | b | c | d |
|---|---|---|---|---|
| 1 | Real SD | Noise | | GND |
| 2 | | | Real SD-(Noise-GND) | GND |

ORGANIC LIGHT EMITTING DIODE DISPLAY FOR SENSING ELECTRICAL CHARACTERISTIC OF DRIVING ELEMENT

This application claims the benefit of Korea Patent Application No. 10-2014-0121091 filed on Sep. 12, 2014, which is incorporated herein by reference for all purposes as if fully set forth herein.

BACKGROUND OF THE INVENTION

Field of the Invention

Embodiments of the invention relate to an organic light emitting diode display. More particularly, embodiments relate to an organic light emitting diode display capable of sensing electrical characteristics of a driving element.

Discussion of the Related Art

An active matrix organic light emitting diode (OLED) display includes organic light emitting diodes (OLEDs) capable of self-emitting light, by itself and has advantages of a fast response time, a high emission efficiency, a high luminance, a wide viewing angle, and the like.

The OLED serving as a self-emitting element includes an anode electrode, a cathode electrode, and an organic compound layer formed between the anode electrode and the cathode electrode. The organic compound layer includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

The OLED display arranges pixels each including the OLED in a matrix form and adjusts a luminance of the pixels based on gray levels of video data. Each pixel includes a driving element, i.e., a driving thin film transistor (TFT) controlling a driving current flowing in the OLED depending on a voltage Vgs between a gate electrode and a source electrode of the driving TFT. Electrical characteristics (including a threshold voltage, a mobility, etc.) of the driving TFT may be deteriorated with the passage of driving time, causing a characteristic variation in the pixels. In other words, a variation in the electrical characteristics of the driving TFTs of the pixels results in a luminance variation in the pixels, to which the same video data is applied. Hence, it is difficult to implement a desired image.

An external compensation method is known to compensate for the variation in the electrical characteristics of the driving TFTs. The external compensation method senses change in the electrical characteristic of the driving TFT through a sensing unit and modulates digital video data through an external circuit by an amount of change in the electrical characteristic of the driving TFT. The external compensation method has an advantage in that a pixel circuit is not complicatedly configured. A method for sensing the change in the electrical characteristic of the driving TFT through the sensing unit of the external compensation method includes a voltage sensing method and a current sensing method.

The voltage sensing method stores a current flowing in the driving TFT, as a voltage, in a line capacitor of a sensing line and then senses the voltage through the sensing unit. However, because a line capacitance of the sensing line is very large, it takes a long time to pull in the current at a voltage level the sensing unit can sense. Furthermore, because the line capacitance varies depending on a display load of the display panel, it is difficult to obtain an accurate sensing value through the voltage sensing method.

On the other hand, as shown in FIG. 1, the current sensing method is configured so that a sensing unit includes a current integrator CI and directly senses a current flowing in the driving TFT. Therefore, the current sensing method can perform the low current and high-speed sensing and also can perform the relatively accurate sensing because an influence of the display load decreases. In the current sensing method, the current flowing in the driving TFT of the pixel is applied to the current integrator CI through the sensing line and is changed into a voltage through an integration process of the current integrator CI. The voltage changed from the current passes through a sample and hold unit SH and is transferred to an analog-to-digital converter (ADC). The ADC converts the voltage into a digital sensing value.

However, because a pixel current (i.e., a source-to-drain current Ids of the driving TFT) Ipix, that generally becomes a target of the sensing, is very small, the current sensing method using the current integrator CI is weak to a noise of an external power source. The noise is generated by a variation in a reference voltage VREF applied to a non-inverting input terminal (+) of an amplifier AMP constituting the current integrator CI, a variation in a reference voltage EVREF applied to one side of a sampling capacitor C of the sample and hold unit SH, a difference between noise sources of sensing lines connected to an inverting input terminal (−) of the amplifier AMP, etc. Because the noise is amplified inside the current integrator CI and is reflected on an integration value, the noise may distort the sensing result as shown in FIG. 2. A first sensing value of FIG. 2, with which the noise is mixed, reduces a sensing performance, resulting in a reduction in a compensation performance.

SUMMARY OF THE INVENTION

Embodiments of the invention provide an organic light emitting diode display capable of increasing a sensing performance by minimizing an influence of a noise when sensing electrical characteristic of a driving element.

In one aspect, there is an organic light emitting diode display comprising a display panel including a plurality of pixels, a plurality of sensing units configured to integrate current information of the pixels through a plurality of sensing channels connected to sensing lines of the display panel and output a first sensing value, a reference sensing unit configured to integrate previously set reference current information and output a reference sensing value, a calculation block configured to calculate the first sensing value and the reference sensing value, remove a common noise component from the first sensing value, and output a second sensing value, and an analog-to-digital converter configured to convert the second sensing value into a digital sensing value.

The calculation block includes a selection unit configured to sequentially output the first sensing values input from the sensing units and an operation unit configured to subtract the reference sensing value from the first sensing value input from the selection unit.

The operation unit includes a first capacitor connected between a first node and a second node, a second capacitor connected between a third node connected to the analog-to-digital converter and a fourth node connected to a ground level voltage source, a first switch connected between a first input terminal, to which the first sensing values are input, and the first node, a second switch connected between a second input terminal, to which the reference sensing value is input, and the second node, a third switch connected between the first node and the third node, and a fourth switch connected between the second node and the fourth node. The first and second switches maintain a turn-on state during a first period and maintain a turn-off state during a second period following the first period. The third and fourth switches maintain a turn-off state during the first period and maintain a turn-on state during the second period.

The operation unit is implemented as a differential amplifier.

The sensing units and the reference sensing unit are driven by the same external power source.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 1:
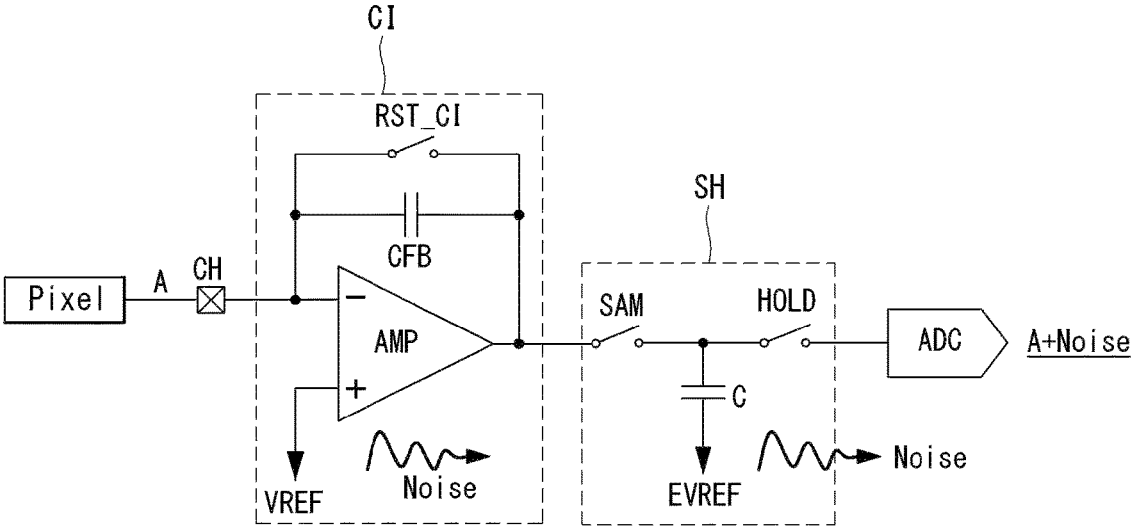
FIG. 1 (RELATED ART)
FIG. 1 shows a noise entering into a sensing unit of a current sensing method.
Figure 2:
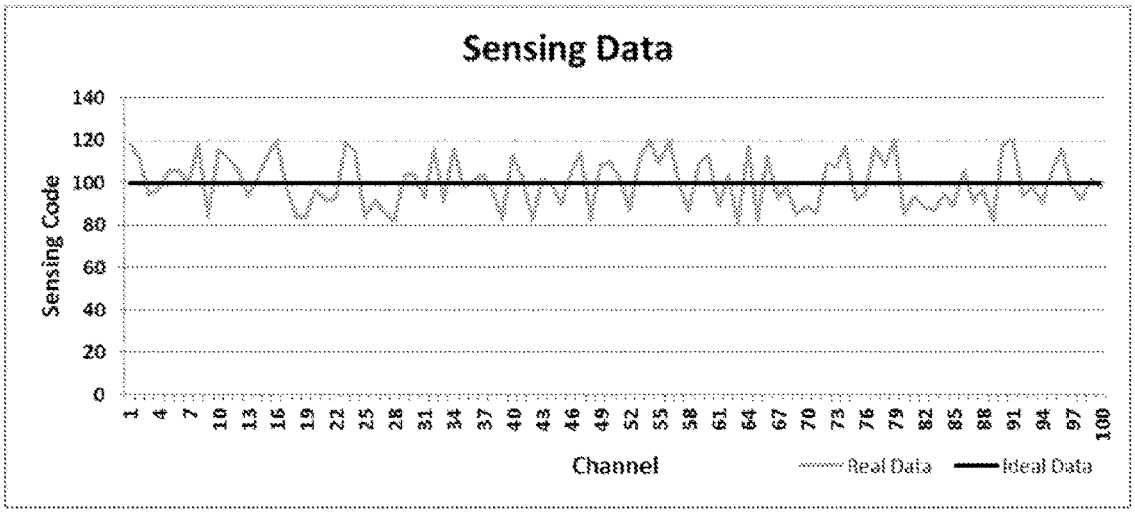
FIG. 2 (RELATED ART)
FIG. 2 shows a first sensing value, with which an external noise is mixed.
Figure 3:
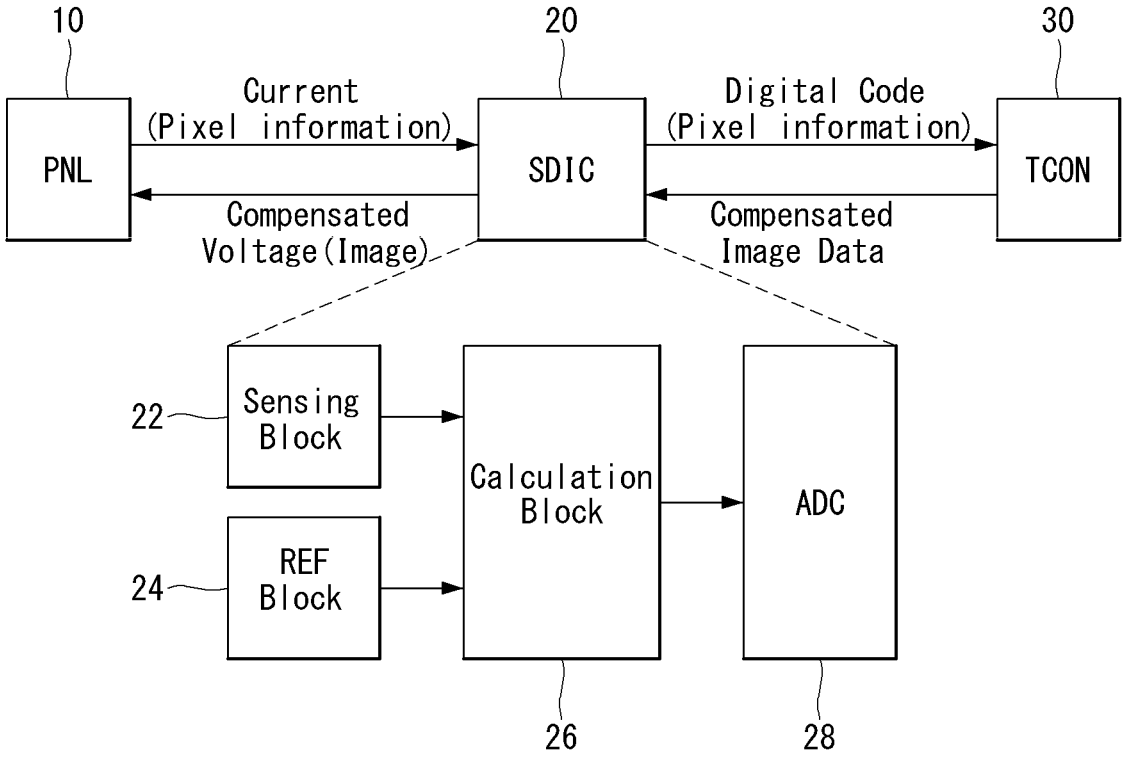
FIG. 3 is a block diagram schematically showing an organic light emitting diode display, sensing electrical characteristic of a driving element using a current sensing method, according to an exemplary embodiment of the invention.
Figure 4:
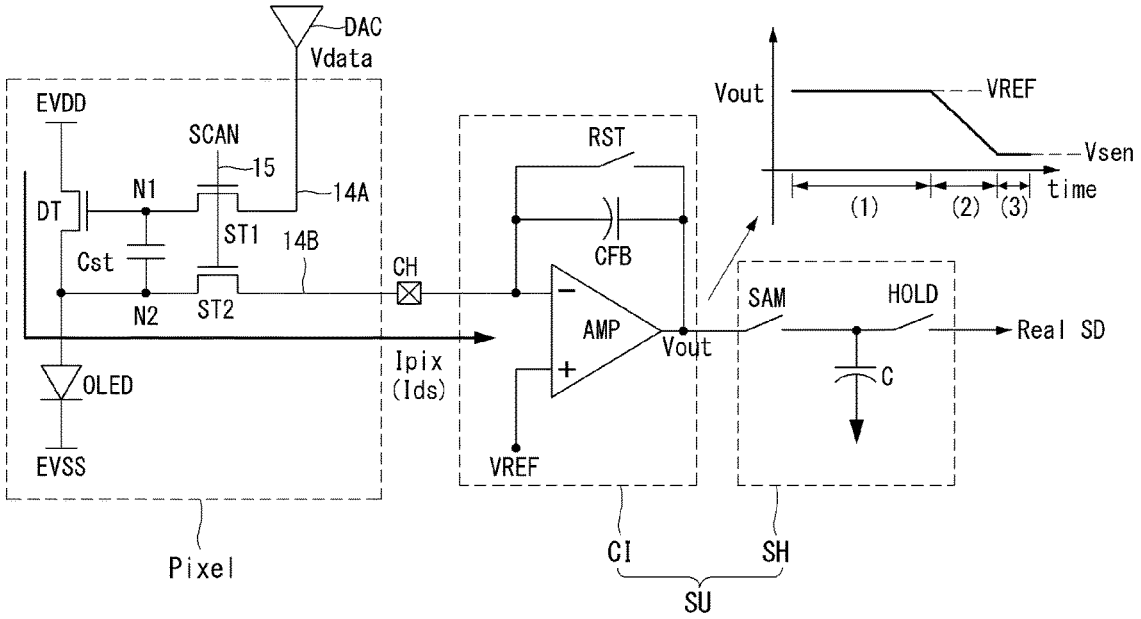
FIG. 4 illustrates a connection structure and a sensing operation of a pixel and a sensing unit, for implementing a current sensing method, according to an exemplary embodiment of the invention.

FIG. 3 is a block diagram schematically showing an organic light emitting diode display, sensing electrical characteristics of a driving element using a current sensing method, according to an exemplary embodiment of the invention. FIG. 4 illustrates a connection structure and a sensing operation of a pixel and a sensing unit, for implementing a current sensing method, according to an exemplary embodiment of the invention.

Referring to FIGS. 3 and 4, the organic light emitting diode display according to the embodiment of the invention includes a display panel 10 (denoted by "PNL"), a source driver integrated circuit (IC) 20 (denoted by "SDIC"), and a timing controller 30 (denoted by "TCON").

A plurality of data and sensing lines 14A and 14B and a plurality of gate lines 15 cross each other on the display panel 10, and pixels are respectively disposed at crossings of the lines 14A, 14B, and 15 in a matrix form.

Each pixel is connected to one of the data lines 14A, one of the sensing lines 14B, and one of the gate lines 15. Each pixel receives a sensing data voltage from the data line 14A in response to a gate pulse input through the gate line 15 and outputs a sensing signal through the sensing line 14B.

Each pixel receives a high potential driving voltage EVDD and a low potential driving voltage EVSS from a power generator (not shown). Each pixel may include an organic light emitting diode (OLED), a driving thin film transistor (TFT) DT, first and second switching TFTs ST1 and ST2, and a storage capacitor Cst. The TFTs constituting the pixel may be implemented as a p-type TFT or an n-type TFT. A semiconductor layer of the TFT constituting the pixel may include amorphous silicon, polysilicon, or oxide.

The source driver IC 20 includes components required to sense a current and senses current information Ipix from the pixels of the display panel 10. The source driver IC 20 includes a sensing block 22 including a plurality of sensing units SU and an analog-to-digital converter (ADC) 28 to output a sensing value. Further, the source driver IC 20 further includes an REF block 24 and a calculation block 26, so as to remove a noise component included in the sensing value.

The REF block 24 includes a reference sensing unit using the same external power source as the sensing units SU of the sensing block 22. Because the reference sensing unit and the sensing unit SU are driven by the same external power source, a common noise component is included in sensing values of the reference sensing unit and the sensing unit SU. The calculation block 26 functions to remove the common noise component.

The sensing unit SU of the sensing block 22 includes a current integrator CI and a sample and hold unit SH. The current Ipix flowing in the pixel is applied to the current integrator CI through the sensing line 14B and is changed into a voltage through an integration process of the current integrator CI. The voltage changed from the current passes through the sample and hold unit SH and is applied to the calculation block 26 as a first sensing value. The reference sensing unit of the REF block 24 uses the same external power source as the sensing units SU of the sensing block 22, integrates previously set reference current information, and applies the result of an integration to the calculation block 26 as a reference sensing value. The calculation block 26 calculates the first sensing value from the sensing block 22 and the reference sensing value from the REF block 24 and removes the common noise component from the first sensing value, thereby outputting a second sensing value. The ADC 28 converts the second sensing value into a digital sensing value.

The timing controller 30 obtains compensation data for compensating for changes in a threshold voltage and a mobility of the driving TFT DT based on the digital sensing value from the source driver IC 20 and modulates image data based on the compensation data. The timing controller 30 then transmits the modulated image data to the source driver IC 20. The modulated image data is converted into an image display data voltage by a digital-to-analog converter (DAC) of the source driver IC 20 and then may be applied to the display panel 10.

A connection structure of one pixel and one sensing unit, for implementing the current sensing method, according to the embodiment of the invention is shown in FIG. 4. Referring to FIG. 4, the pixel may include the OLED, the driving TFT DT, the first and second switching TFTs ST1 and ST2, and the storage capacitor Cst.

The OLED includes an anode electrode connected to a second node N2, a cathode electrode connected to an input terminal of the low potential driving voltage EVSS, and an organic compound layer formed between the anode electrode and the cathode electrode. The driving TFT DT controls an amount of current input to the OLED based on a gate-to-source voltage Vgs of the driving TFT DT. The driving TFT DT includes a gate electrode connected to a first node N1, a drain electrode connected to an input terminal of the high potential driving voltage EVDD, and a source electrode connected to the second node N2. The storage capacitor Cst is connected between the first node N1 and the second node N2. The first switching TFT ST1 is turned on in response to a gate pulse SCAN and applies a data voltage Vdata on the data line 14A to the first node N1. The first switching TFT ST1 includes a gate electrode connected to the gate line 15, a drain electrode connected to the data line 14A, and a source electrode connected to the first node N1. The second switching TFT ST2 switches on or off a current flow between the second node N2 and the sensing line 14B in response to the gate pulse SCAN. The second switching TFT ST2 includes a gate electrode connected to the gate line 15, a drain electrode connected to the sensing line 14B, and a source electrode connected to the second node N2.

As shown in FIG. 4, the current integrator CI includes an amplifier AMP including an inverting input terminal (−) receiving the pixel current Ipix (i.e., a source-to-drain current Ids of the driving TFT DT) from the sensing line 14B through a sensing channel CH, a non-inverting input terminal (+) receiving a reference voltage VREF, and an output terminal, an integrating capacitor CFB connected between the inverting input terminal (−) and the output terminal of the amplifier AMP, and a reset switch RST connected to both terminals of the integrating capacitor CFB.

The sample and hold unit SH is connected to an output terminal of the current integrator CI. The sample and hold unit SH includes a sampling switch SAM for sampling an integration value Vsen of the current integrator CI, a sampling capacitor C storing the integration value Vsen applied through the sampling switch SAM, and a holding switch HOLD outputting the integration value Vsen stored in the sampling capacitor C as the first sensing value.

An operation of the current integrator CI may be dividedly described in an initialization period (1), a sensing period (2), and a sampling period (3).

In the initialization period (1), the amplifier AMP operates as a unit gain buffer of a gain "1" due to a turn-on of the reset switch RST. Further, all of the input terminals (+) and (−) and the output terminal of the amplifier AMP, the sensing line 14B, and the second node N2 are initialized to the reference voltage VREF.

In the initialization period (1), the sensing data voltage Vdata is applied to the first node N1 through the DAC of the source driver IC 20. Hence, the source-to-drain current Ids corresponding to a voltage difference (=Vdata-VREF) between the first node N1 and the second node N2 flows in the driving TFT DT, thereby stabilizing the driving TFT DT. However, because the amplifier AMP continuously operates as the unit gain buffer during the initialization period (1), a voltage of the output terminal of the amplifier AMP is held at the reference voltage VREF.

In the sensing period (2), the amplifier AMP operates as the current integrator CI due to a turn-off of the reset switch RST, and the source-to-drain current Ids flowing in the driving TFT DT is stored in the integrating capacitor CFB through an integration operation. In the sensing period (2), a voltage difference between both terminals of the integrating capacitor CFB increases due to the source-to-drain current Ids entering into the inverting input terminal (−) of the amplifier AMP, as a sensing time passed (i.e., as an accumulation amount of source-to-drain current Ids increases). However, the inverting input terminal (−) and the non-inverting input terminal (+) of the amplifier AMP are shorted through a virtual ground due to characteristic of the amplifier AMP, and a voltage difference between the inverting input terminal (−) and the non-inverting input terminal (+) of the amplifier AMP is zero. Therefore, a voltage of the inverting input terminal (−) is held at the reference voltage VREF in the sensing period (2), irrespective of an increase in the voltage difference between both terminals of the integrating capacitor CFB. Instead, a voltage of the output terminal of the amplifier AMP decreases correspondingly to an increase in the voltage difference between both terminals of the integrating capacitor CFB. By such a principle, the source-to-drain current Ids entering through the sensing line 14B in the sensing period (2) is changed into an output value Vout expressed as voltage through the integrating capacitor CFB. A falling slope of the output value Vout increases as an amount of the source-to-drain current Ids entering through the sensing line 14B increases. Therefore, as the amount of the source-to-drain current Ids increases, the integration value Vsen decreases. In the sensing period (2), the integration value Vsen is stored in the sampling capacitor C via the sampling switch SAM.

In the sampling period (3), when the holding switch HOLD is turned on, the integration value Vsen stored in the sampling capacitor C is output as the first sensing value via the holding switch HOLD.

Figure 5:
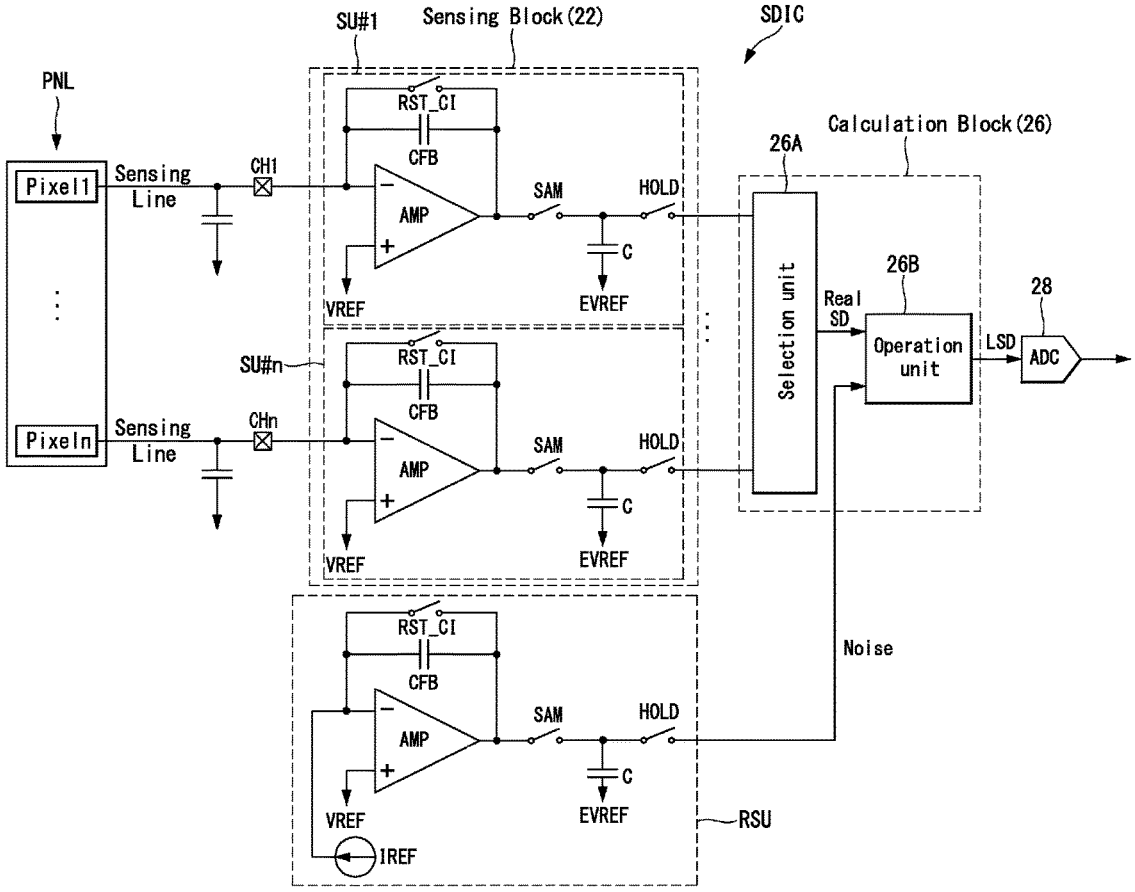
FIG. 5 illustrates detailed configuration of a sensing block including a plurality of sensing units, detailed configuration of an REF block including a reference sensing unit, and detailed configuration of a calculation block removing a common noise component.
Figures 6, 7:
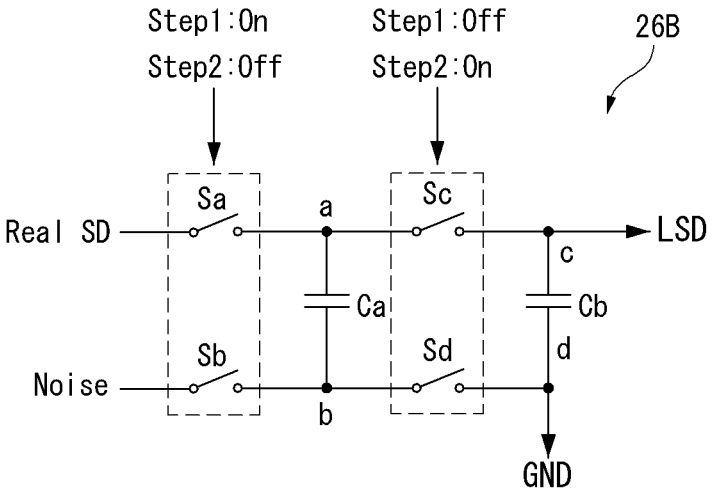
FIG. 6 shows an example of implementing an operation unit included in a calculation block.
FIG. 7 illustrates an operation of an operation unit shown in FIG. 6.
Figure 8:
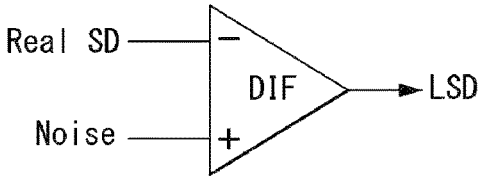
FIG. 8 shows another example of implementing an operation unit included in a calculation block.

FIG. 5 illustrates a detailed configuration of a sensing block 22 including a plurality of sensing units, a detailed configuration of an REF block including a reference sensing unit, and a detailed configuration of a calculation block 26 removing a common noise component. FIG. 6 shows an example of implementing an operation unit included in a calculation block. FIG. 7 illustrates an operation of an operation unit shown in FIG. 6. FIG. 8 shows another example of implementing an operation unit included in a calculation block.

Referring to FIG. 5, a plurality of sensing units SU#1 to SU#n are connected to the pixels through sensing channels CH1 to CHn and the sensing lines 14B and sense pixel current information. A connection structure and an operation of the sensing units SU#1 to SU#n are substantially the same as those described in FIG. 4.

A reference sensing unit RSU of the REF block 24 is connected to a reference current source IREF and senses reference current information. For this, the reference sensing unit RSU includes a current integrator and a sample and hold unit in the same manner as the sensing units SU#1 to SU#n. An inverting input terminal (−) of the current integrator included in the reference sensing unit RSU is connected to the reference current source IREF.

It is preferable, but not required, that the reference sensing unit RSU is designed so that the reference sensing unit RSU is affected by the same noise as the sensing units SU#1 to SU#n so as to easily remove the noise. For this, the current integrator of the reference sensing unit RSU is designed so that it receives the same external power source VREF as the current integrators of the sensing units SU#1 to SU#n. Further, the sample and hold unit of the reference sensing unit RSU may receive the same external power source EVREF as the sample and hold units of the sensing units SU#1 to SU#n.

Because the reference sensing unit RSU and the sensing units SU#1 to SU#n share the external power source with each other, a first sensing value Real SD of the sensing unit SU and the reference sensing value of the reference sensing unit RSU include the same noise component (i.e., the common noise component). The common noise component is removed by the calculation block 26. When a reference current value of the reference current source IREF is properly designed, only the noise component may be included in the reference sensing value output from the reference sensing unit RSU. In this instance, the operation of the calculation block 26 becomes simple.

The calculation block 26 may include a selection unit 26A sequentially outputting the first sensing values Real SD input from the sensing units SU#1 to SU#n and an operation unit 26B subtracting the reference sensing value from the first sensing value Real SD input from the selection unit 26A.

As shown in FIG. 6, the operation unit 26B may include four switches Sa, Sb, Sc, and Sd and two capacitors Ca and Cb.

More specifically, the operation unit 26B may include the first capacitor Ca connected between a first node 'a' and a second node 'b', the second capacitor Cb connected between a third node 'c' connected to the ADC 28 and a fourth node 'd' connected to a ground level voltage source GND, the first switch Sa connected between a first input terminal, to which the first sensing values Real SD are input, and the first node 'a', the second switch Sb connected between a second input terminal, to which the reference sensing value is input, and the second node 'b', the third switch Sc connected between the first node 'a' and the third node 'c', and the fourth switch Sd connected between the second node 'b' and the fourth node 'd'.

The first and second switches Sa and Sb maintain a turn-on state during a first period Step1 and maintain a turn-off state during a second period Step2 following the first period Step 1. On the contrary, the third and fourth switches Sc and Sd maintain a turn-off state during the first period Step1 and maintain a turn-on state during the second period Step2.

As shown in FIG. 7, during the first period Step1, the first sensing value Real SD including the common noise component is applied to the first node 'a', and the reference sensing value including the common noise component is applied to the second node 'b'. During the second period Step2, the first node 'a' and the third node 'c' are shorted, and the second node 'b' and the fourth node 'd' are shorted. The reference sensing value stored in the second node 'b' is reduced to a ground value in the second period Step2, and thus the first sensing value Real SD of the third node 'c' is reduced to the voltage of the second node 'b' in the second period Step2. As a result, the common noise component is removed from the first sensing value Real SD.

As shown in FIG. 8, the operation unit 26B may be implemented as a differential amplifier differentially amplifying the first sensing value Real SD input from a first input terminal (−) and the reference sensing value input from a second input terminal (+).

Figure 9:
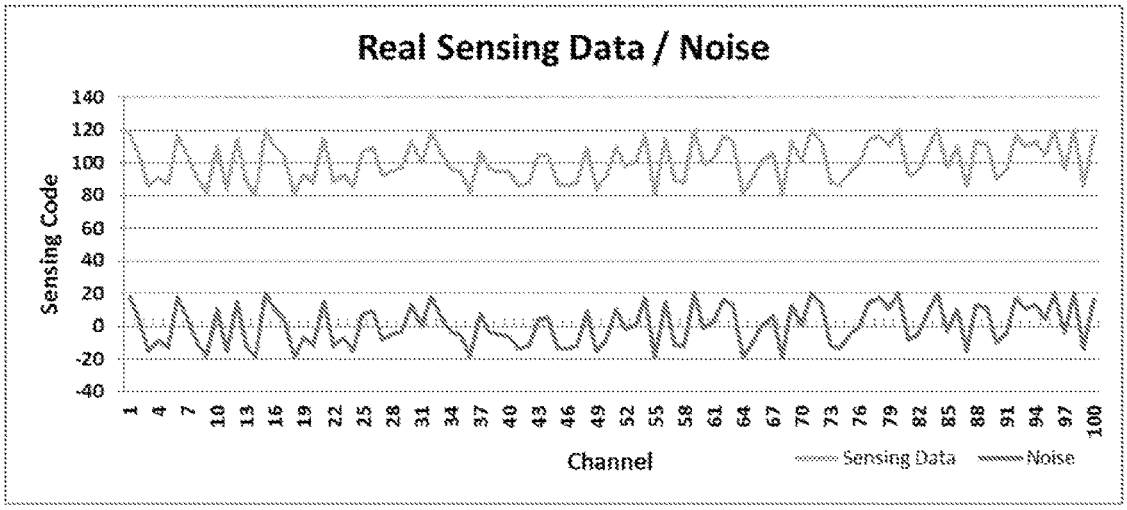
FIG. 9 shows a first sensing value and a reference sensing value each including a common noise component.
Figure 10:
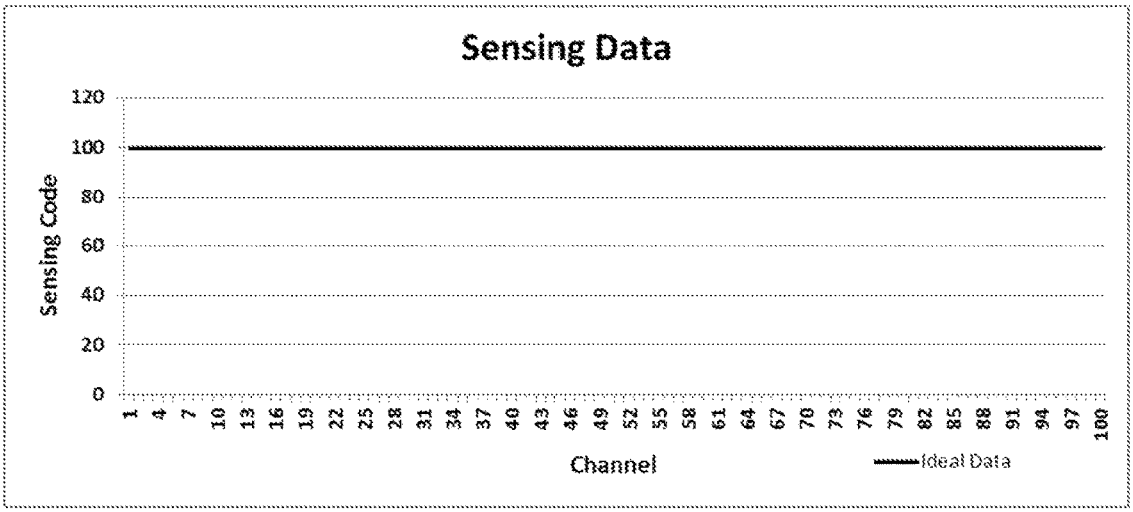
FIG. 10 shows a second sensing value, from which a common noise component is removed.

As shown in FIG. 9, the operation unit 26B receives the first sensing value and the reference sensing value each including the common noise component. As shown in FIG. 10, the operation unit 26B outputs the second sensing value, from which the common noise component is removed.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising:

a display panel including a plurality of pixels;

a plurality of sensing units, each of which includes a current integrator and a sample and hold unit, that integrate current information of the pixels through a plurality of sensing channels connected to sensing lines of the display panel and output a first sensing value;

a reference sensing unit that is separate and distinct from the plurality of sensing units and includes a current integrator electrically connected to a previously set reference current source and a first same external power source applied to each current integrator of the plurality of sensing units and a sample and holder unit electrically connected to a second same external power source applied to each sample and hold unit of the plurality of sensing units, wherein the reference sensing unit senses reference current information and outputs a reference sensing value;

a calculation block that calculates the first sensing value and the reference sensing value, removes a common noise component from the first sensing value, and outputs a second sensing value; and an analog-to-digital converter that converts the second sensing value into a digital sensing value, wherein the calculation block includes an operation circuit that subtracts the reference sensing value from the first sensing value input sequentially from the plurality of sensing units, wherein the operation circuit includes:

a first capacitor connected between a first node and a second node;

a second capacitor connected between a third node connected to the analog-to-digital converter and a fourth node connected to a ground level voltage source;

a third switch connected between the first node and the third node; and a fourth switch connected between the second node and the fourth node.

2. The organic light emitting diode display of claim 1, wherein the operation circuit further includes:

a first switch connected between a first input terminal, to which the first sensing values are input, and the first node; and a second switch connected between a second input terminal, to which the reference sensing value is input, and the second node, wherein the first and second switches maintain a turn-on state during a first period and maintain a turn-off state during a second period following the first period, and wherein the third and fourth switches maintain a turn-off state during the first period and maintain a turn-on state during the second period.

* * * * *